US008225434B2

(12) United States Patent
Grohe

(10) Patent No.: US 8,225,434 B2
(45) Date of Patent: Jul. 24, 2012

(54) WALL HOOK FOR A SHOWER ATTACHMENT

(75) Inventor: Klaus Grohe, Schiltach (DE)

(73) Assignee: Hansgrohe AG, Schiltach (DE)

( * ) Notice: Subject to any disclaimer, the term of this patent is extended or adjusted under 35 U.S.C. 154(b) by 3 days.

(21) Appl. No.: 10/585,560

(22) PCT Filed: Dec. 23, 2004

(86) PCT No.: PCT/EP2004/014659

§ 371 (c)(1),
(2), (4) Date: Sep. 21, 2007

(87) PCT Pub. No.: WO2005/068731

PCT Pub. Date: Jul. 28, 2005

(65) Prior Publication Data

US 2008/0244826 A1 Oct. 9, 2008

(30) Foreign Application Priority Data

Jan. 14, 2004 (DE) ..... 10 2004 003 134

(51) Int. Cl.
*A47K 3/20* (2006.01)

(52) U.S. Cl. ..... 4/570; 4/695

(58) Field of Classification Search ..... 4/570, 601, 4/695; 248/316.1; D23/304
See application file for complete search history.

(56) References Cited

U.S. PATENT DOCUMENTS

| | | | | | |
|---|---|---|---|---|---|
| 4,274,400 | A * | 6/1981 | Baus | 601/169 |
| 4,662,768 | A | 5/1987 | Gottwald et al. | |
| 4,726,552 | A * | 2/1988 | Warshawsky | 248/122.1 |
| 5,277,391 | A * | 1/1994 | Haug et al. | 248/219.3 |
| 5,299,593 | A | 4/1994 | Ottelli | |
| D385,333 | S * | 10/1997 | Caroen et al. | D23/228 |
| 5,833,192 | A * | 11/1998 | Buhrman | 248/295.11 |
| 6,123,308 | A * | 9/2000 | Faisst | 248/316.1 |
| 6,361,005 | B1 * | 3/2002 | Faisst et al. | 248/219.4 |
| 2003/0221251 | A1 * | 12/2003 | Tse | 4/570 |

FOREIGN PATENT DOCUMENTS

| | | |
|---|---|---|
| CH | 340460 | 9/1959 |
| DE | 18 12 194 U | 5/1960 |
| DE | 75 25 923 U | 12/1975 |
| DE | 27 20 507 A1 | 11/1978 |
| DE | 30 33 943 A1 | 7/1982 |
| DE | 83 25 385 U1 | 12/1983 |
| DE | 40 00 621 A1 | 7/1991 |
| DE | 195 10 940 A1 | 9/1996 |

(Continued)

OTHER PUBLICATIONS

German Search Report; Nov. 17, 2004.

(Continued)

*Primary Examiner* — Gregory Huson
*Assistant Examiner* — Karen L Younkins
(74) *Attorney, Agent, or Firm* — Duane Morris LLP

(57) ABSTRACT

The invention relates to a wall rod (1) to be applied in front of a vertical wall by means of wall supports (6), said wall rod comprising an extension on the upper end thereof, that extends in an arched manner away from the wall. The handle of a shower attachment can be inserted into the free end of said arched pipe extension, and the tube is guided downwards on the rear side of the wall rod (1).

13 Claims, 2 Drawing Sheets

FOREIGN PATENT DOCUMENTS

Figures 1, 2:
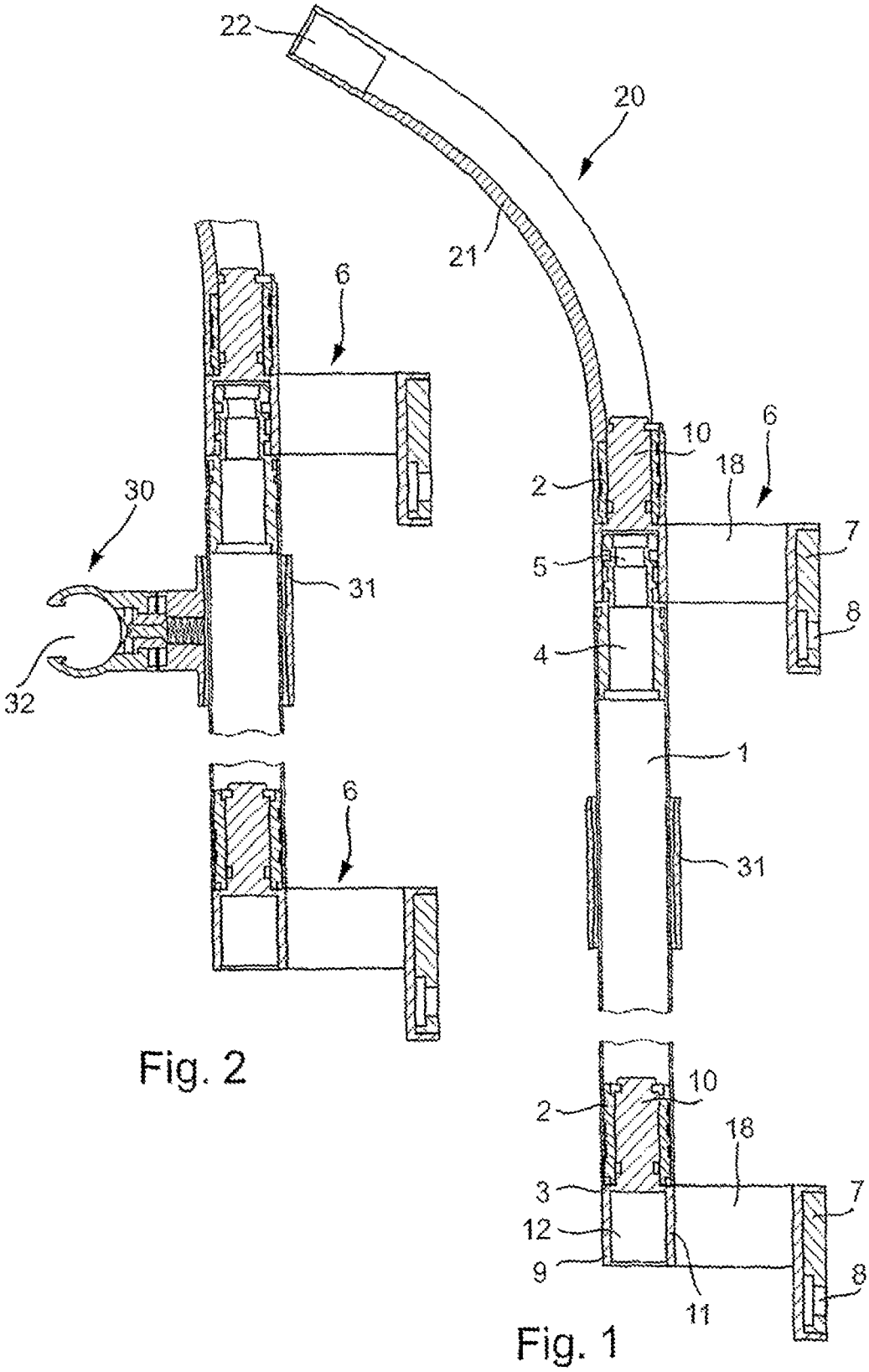

| | | | |
|---|---|---|---|
| DE | 196 49 005 | A1 | 5/1998 |
| DE | 19710396 | A1 | 9/1998 |
| DE | 201 13 921 | U1 | 1/2002 |
| DE | 101 09 448 | A1 | 9/2002 |
| DE | 203 08 419 | U1 | 9/2003 |
| EP | 0 076 717 | | 4/1983 |
| EP | 0 103 145 | A2 | 3/1984 |
| JP | 2001220783 | A | 8/2001 |
| JP | 2002194785 | A | 7/2002 |

OTHER PUBLICATIONS

PCT Search Report; Apr. 18, 2005.
English Translation of International Preliminary Report on Patentability; Oct. 12, 2006.
Russian Office Action, Sep. 11, 2007.
English translation of office action cited in corresponding Russian application No. 2006124234.

* cited by examiner

WALL HOOK FOR A SHOWER ATTACHMENT

The invention refers to a wall bracket for a shower attachment with a perpendicularly aligned wall rod on which a mounting bracket is attached and a shower attachment can be inserted, for example with the handle.

Such wall rods have been familiar for a long time. They have the advantage that the height of the shower attachment can be adjusted relative to the body size, wherein it is also possible to shower while sitting. The shower attachment can also be detached from the mounting bracket and used to rinse off the body. The disadvantage of this type of mounting for shower attachments is that the shower outlet hose is always adapted to the maximum possibility of adjustment and are therefore normally longer so that when the shower attachment is hung on the wall rod it hangs down in a disturbing manner.

These disadvantages don't exist with firmly installed overhead shower outlets. However, these have the disadvantage that they are normally not adjustable. Even if they are attached with the help of a joint, the position of the shower head cannot be adjusted, apart from the angle in which it sprays water.

In a known wall bracket a slider is attached on a vertically installed wall rod on which a shower head with a pivoted mounting is attached. The feed line to this shower head is provided via a hose (DE 27 20 507). The shower head can not be detached.

Likewise, a wall rod (EP A76717) is known which comprises a permanently installed part and a telescopically displaceable part fitted protruding upwards opposite the permanently installed part. On the upper end of the displaceable part the handle of a shower attached is attached which obtains water from a hose.

The invention is based on the task of expanding and improving the application and possibilities of using a shower attachment.

To solve this task, the invention proposes a wall bracket for a shower attachment with the features mentioned in Claim 1. Further developments of the invention are object of subordinate Claims.

Although in the state of the art the mounting bracket for the shower attachment is normally a separate part that is perceived as a partly disturbing element, the invention provides that the mounting bracket is designed such that it forms a projection of the wall rod. Expressed otherwise, the mounting bracket is located in the projection of the wall rod. Therefore, an optically appealing overall impression of the wall rod is achieved and gives a complementing image that does not disturb anymore.

In particular, the invention provides that the mounting bracket for the shower attachment is formed as an overhead projection of the wall rod, so that the shower attachment which is fitted in the mounting bracket can act as an overhead shower outlet. It can also be removed from the mounting bracket and used as a shower attachment.

To make adjustment or adaptation to different conditions possible when using the shower attachment as an overhead shower outlet, it can be provided according to the invention that the mounting bracket is pivoted, preferably about the longitudinal axis of the wall rod or about an axis parallel thereto. In this manner, it is possible to shift the shower attachment that is attached to the mounting bracket towards the right or left of a center position. Especially when attaching such a wall bracket to a bathtub it is possible in this manner that the user can stand at different positions in the bathtub.

Especially in a further development of the invention, it can be provided that the mounting bracket is curved, wherein preferably the centerline of the mounting bracket lies in a plane in which, if necessary, also the axis of the wall rod lies. Due to the curved form, the wall rod can be optically continued providing the possibility that the shower attachment fitted in the mounting bracket points downwards. The curved form makes it possible therefore that the hose leading to the shower attachment may be held such that it no longer disturbs.

Especially in a further development of the invention it can be provided that the mounting bracket is formed as an open pipe with a cone on the external end towards the rear side and/or towards the lateral side. The cone, which is known, is used for inserting the handle of the shower attachment. The opening on the rear side and/or on the lateral side can advantageously serve for holding the shower outlet hose during this process so that it is safely accommodated and does not disturb. This possibility is further improved in that the opening features the form of an undercut slot.

In a further development of the invention it can be provided that at least a wall support is formed with a double-bend. Through this double-bend, a space is created in which the shower outlet hose can hang downwards between the wall rod and the vertical surface so that it disturbs even less.

Particularly, it can be provided that at least a wall support is located with displacement about at least half the diameter of the shower attachment hose, laterally opposite the wall rod.

In accordance with the invention, the swivel support of the shower outlet holder can be located in the wall support.

The swivel support can be formed such that the swiveling motion of the mounting bracket is restricted before it reaches the vertical surface on which the wall rod is mounted with the help of the wall supports. In this manner, contact between the shower attachment and the wall is prevented. At the same time the shower spray is prevented from reaching the wall, but only the person taking shower.

In a further development it can be provided that the swivel support is provided with a notch that favors certain positions of the mounting bracket. Particularly, it shall be provided that the mounting bracket remains stationary in the neutral position.

In accordance with the invention, the wall bracket can exhibit an additional hose guide which is preferably located behind the wall rod, thus, between the wall rod and the wall.

It is also possible to attach a further mounting bracket for the shower attachment on the wall rod itself in order to be able to lock the shower attachment in a lower position. This additional mounting bracket can also be pivoted about the wall rod and thus be adjustable in height. Preferably, it is provided that the rotation about the wall rod takes place independent of whether or not the wall rod is rotated.

To fix a wall rod, it is normally provided that two wall supports are used. It is also possible that a wall rod consists of more than one part, for instance, two pipe sections, so that three wall supports can be used if necessary.

Further features, details and preferences of the invention arise from the following description of a preferred embodiment, the patent claims and the abstract that both refer to the content of the description and to the drawings.

Figure 3:
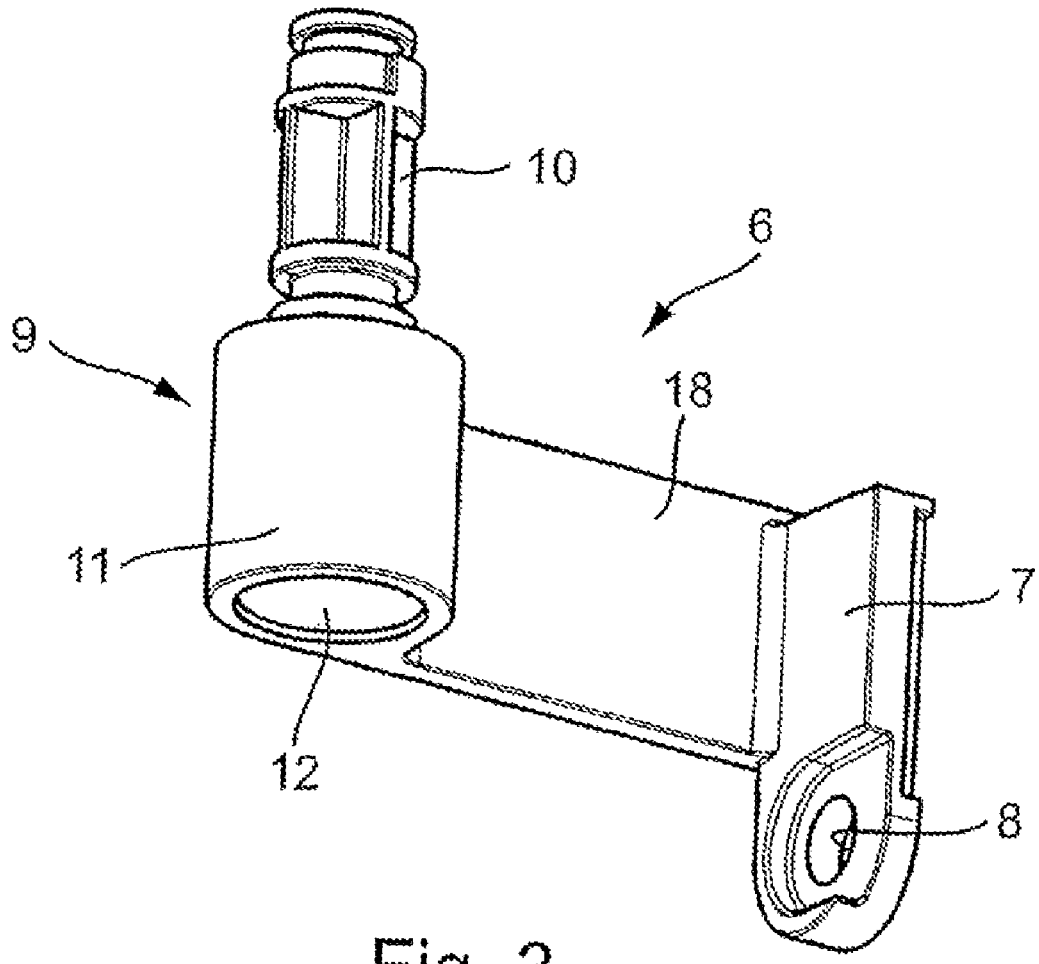

The following are shown:

FIG. 1 an axial section through a wall bracket according to the invention, without a shower attachment;

FIG. 2 a shortened section with an additional bracket in comparison to FIG. 1;

FIG. 3 perspective of a wall support.

The wall bracket schematically depicted in FIG. 1 contains a pipe 1 as a central element that is provided with a cartridge-type bearing 2 in the section of its lower end. The cartridge-type bearing 2 is inserted from the bottom into the pipe 1 and lies pointing outwards with a flange 3 on the face edge of the pipe.

In the section of its upper end, the pipe also features a cartridge-type bearing 4 that is inserted into the pipe from the top. From the upper end of the pipe 1 a part 5 of the cartridge-type bearing protrudes. This protruding part 5 of the cartridge-type bearing 4 corresponds in its outer dimensions to the inner dimensions of the cartridge-type bearing 2.

To fix the pipe 1 with its cartridge-type bearings 2, 4, two wall supports 6 are used, which are both identically formed. Each wall support 6 contains a base plate 7 to be screwed on the wall that features a step hole 8. Through the step hole 8, screws can be screwed, the heads of said screws then come to rest on the prolonged part of the step hole 8. This base plate 7 is joined with a brace 18. On the outer end of the brace 18 which is opposite the base plate 7, a bearing element 9 is provided, which exhibits a cylindrical part 10 pointing upwards and reduced in diameter and a lower section 11 with an internal hole 12. The dimensions of the internal hole 12 correspond to the outer dimensions of the protruding parts 5 of the cartridge-type bearing 4 in the upper part of the pipe 1.

The pipe 1 with its cartridge-type bearing 2 is pushed over the bearing extension 10 of the wall support 6, reduced in diameter, until the cartridge-type bearing 2 comes to rest on the shoulder 13 in the transition part between both parts 11, 10 of the wall support 6. The outer circumference of the lower part 11 of the bearing 9 of the wall support 6 corresponds to the outer diameter of the pipe 1, so that in this manner the outer form of the pipe is prolonged up to the lower end of the wall support 6.

On the upper end, the protruding part 5 of the cartridge-type bearing 4 of the pipe is inserted in to the recess 12 of the upper wall support 6, likewise until it rests on the corresponding shoulders. In this manner, the pipe 1 is held firmly between the two wall supports 6. Both wall supports 6 are formed identically. From the upper wall support 6 only the projection 10 protrudes upwards. The mounting bracket 20 of the shower head is put on this projection 10. The mounting bracket 20 features the form of a pipe that is slotted on the rear side. In the lower end of this pipe section, a cartridge-type bearing 2 is likewise inserted similarly to the lower end of the pipe 1 of the wall rod. Between this cartridge-type bearing 2 and the protruding part 10 of the upper wall support there is a connection. Herewith, the pipe piece 21 is fixed on the wall slot 6. The connection between the protruding part 10 of the bearing of the wall support 6 and the cartridge-type bearing 2 of the pipe pieces 21 can be designed so that it can rotate about its two axes, if necessary, with the possibility of being locked in certain positions.

The top end of the curved pipe pieces 21 exhibits a conical bracket 22 for the handle of a shower attachment. This conical bracket is known and therefore not further explained.

If the handle of a shower attachment is inserted in the conical bracket 22 then the shower outlet hose can be guided through the interior of the pipe piece 21 up to the connection with one of the wall supports 6. From this point it can hang freely downwards, wherein it then comes to rest in the section between the wall rod and the base plates of the wall support 6. At this point it can hang freely without disturbing.

FIG. 2 shows that an additional mounting bracket 30 for a shower attachment can be attached to the wall rod formed by pipe 1. The mounting bracket is pushed over on the pipe 1 as a sleeve 31 prior to mounting with help of the wall slots 6. It can exhibit spring elements so that it can retain its acquired position both in axial direction of the wall rod as well as in the circumferential direction. The front bracket opening 32 can therefore be rotated additionally about a horizontal axis if necessary. The shower attachment, which is removed from the mounting bracket 20 on the upper end of the wall rod, can then be inserted in the mounting bracket 30.

FIG. 3 shows a wall support in a magnified perspective scale in comparison to FIGS. 1 and 2, in the form in which it is used for fixing the pipe 1. The base plates 7 are longitudinally stretched with a lower rounding. The longitudinal edge runs perpendicular from top to bottom in the case of attachment on the wall. In the section of one longitudinal side edge, the web 18 is attached, which runs at a right angle opposite to the rear side of the base plate 7. The rear side of the base plate 7 is meant to lie flat on the wall.

On the front end of the web 18 it turns tangentially into the bearing 9. The projection 10 previously mentioned, with a reduced diameter, exhibits a somewhat more complicated design than depicted on the simplified illustration of FIGS. 1 and 2. Its outer contour exhibits a diameter that corresponds to the inner diameter 1 of the lower opening 12.

Through the lateral offset of the web 18 opposite to the base plate and particularly opposite the bearing 9, this web is laterally offset opposite the wall rod. In this manner, a hose hanging directly behind the wall rod has space in order to be accommodated.

Through the pivoted support of the mounting bracket 20 about the axis of the wall rod, the shower attachment forming an overhead shower outlet can be swiveled to the right and left. It can therefore be removed and used as a normal shower attachment.

The arrangement combines the advantages of a permanently installed overhead shower outlet with the advantage of a shower attachment that can be used without a mounting bracket.

What is claimed is:

1. A wall bracket for holding a shower attachment, comprising:

a wall support having a base plate adapted to be attached to a wall;

a wall rod fixed to the wall support at a space in front of the base plate, at least one mounting bracket attachable to the wall rod for carrying the shower attachment, wherein the mounting bracket for the shower attachment comprises a lengthwise extension of the wall rod, the mounting bracket being formed as a continuation extending the wall rod upwardly, wherein a centerline of the mounting bracket lies in a plane that includes a longitudinal axis of the wall rod, wherein the mounting bracket is curved and comprises a bracket for holding a shower attachment at an end of the mounting bracket and the mounting bracket forms a pipe that is slotted along a rear side toward the base plate, adapted for removably receiving an outlet hose leading to the bracket for the shower attachment at the end of the mounting bracket.

2. The wall bracket according to claim 1, in which the mounting bracket pivots about the longitudinal axis of the wall rod.

3. The wall bracket according to claim 1, comprising at least one said wall support with a double-bent form.

4. The wall bracket according to claim 1, comprising at least one said wall support that is offset by at least half a diameter of a hose leading to the shower attachment, laterally opposite from the wall rod.

5. The wall bracket according to claim 1, comprising a swivel bearing for a shower outlet holder, located in the wall support.

6. The wall bracket according to claim 5, wherein the swivel bearing is formed to limit swiveling of the mounting bracket so that the mounting bracket does not reach the base plate.

7. The wall bracket according to claim 5, wherein the swivel bearing is formed to provide a stepped swivel motion.

8. The wall bracket according to claim 1, wherein the wall support and the mounting bracket allow the outlet hose to hang freely downwards between the wall rod and the base plate.

9. The wall bracket according to claim 1, further comprising an additional bracket for the shower attachment, located on the wall rod, wherein the additional bracket swivels around the wall rod.

10. The wall bracket according to claim 1, wherein the mounting bracket is structured for attachment to the wall rod and for insertion of the shower attachment.

11. The wall bracket according to claim 2, wherein the mounting bracket is pivotable about one of a longitudinal axis of the wall rod and an axis parallel to the longitudinal axis of the wall rod.

12. The wall bracket according to claim 7, wherein the mounting bracket is stepped in a neutral position of the swivel bearing.

13. The wall bracket according to claim 9, wherein the additional bracket is adjustable in an axial direction along the wall rod.

* * * * *